US010648333B2

(12) United States Patent
Zhu et al.

(10) Patent No.: US 10,648,333 B2
(45) Date of Patent: May 12, 2020

(54) MIXING AND GUNITING DEVICE OF NEW TYPE FOR TBM

(71) Applicant: CHINA RAILWAY ENGINEERING EQUIPMENT GROUP CO., LTD., Zhengzhou (CN)

(72) Inventors: Ying Zhu, Zhengzhou (CN); Guang Li, Zhengzhou (CN); Jian Huang, Zhengzhou (CN); Xiao Zhang, Zhengzhou (CN); Baozong Chen, Zhengzhou (CN)

( * ) Notice: Subject to any disclaimer, the term of this patent is extended or adjusted under 35 U.S.C. 154(b) by 0 days.

(21) Appl. No.: 16/475,008

(22) PCT Filed: Nov. 23, 2017

(86) PCT No.: PCT/CN2017/112564
§ 371 (c)(1),
(2) Date: Jun. 28, 2019

(87) PCT Pub. No.: WO2018/121142
PCT Pub. Date: Jul. 5, 2018

(65) Prior Publication Data

US 2020/0003056 A1 Jan. 2, 2020

(30) Foreign Application Priority Data

Dec. 30, 2016 (CN) ..... 2016 1 1250747

(51) Int. Cl.
*E21D 11/10* (2006.01)
*E21D 9/06* (2006.01)

(52) U.S. Cl.
CPC ..... *E21D 9/0607* (2013.01); *E21D 11/105* (2013.01)

(58) Field of Classification Search
CPC ..... E21D 11/10; E21D 11/105; E04G 21/02
See application file for complete search history.

(56) References Cited

U.S. PATENT DOCUMENTS 4,046,357 A * 9/1977 Twitchell ..... B05B 7/149 366/27

FOREIGN PATENT DOCUMENTS

DE 19652811 A1 * 7/1997
WO WO 2013056450 A1 * 4/2013

* cited by examiner

*Primary Examiner* — Sunil Singh
(74) *Attorney, Agent, or Firm* — Novoclaims Patent Services LLC; Mei Lin Wong

(57) ABSTRACT

Disclosed is a mixing and guniting device of a new type for a TBM, wherein the device comprises a concrete inlet pipe (1), a four-way pipe (15), a nozzle (4), an agitator motor (5), a longitudinal swing oil cylinder (6), a flow mixer, a lateral swing oil cylinder (16), a telescopic oil cylinder (7) connected to a big arm, and a controller, one end of the telescopic oil cylinder (7) being provided with a connection plate (12), the four-way pipe (15) being fixed on the upper part of the connecting plate (12), two interfaces in the upper part of the four-way pipe (15) being respectively provided with an air inlet pipe (2) and an accelerator inlet pipe, a measuring sensor connected to the controller being provided in the air inlet pipe (2), two interfaces in the lower part of the four-way pipe (15) being respectively provided with bent pipes (8), the other ends of the bent pipes (8) being in communication with the flow mixer, the nozzle (4) being provided in the upper part of the flow mixer, the concrete inlet pipe (1) being provided in the lower part of the flow mixer, and the concrete inlet pipe (1) being in communication with the nozzle (4) and the bent pipe (8) via the flow mixer. The mixing and guniting device can adjust the distance and the angle between the nozzle and a sprayed face intelligently and in real time according to the air flow, so as to ensure a suitable distance at which the rebound rate is lowest and the best angle at which the nozzle is always perpendicular to the sprayed face, such that the rebound rate (Continued)

is effectively reduced with less loss of concrete, energy conservation and environmental protection.

7 Claims, 2 Drawing Sheets

MIXING AND GUNITING DEVICE OF NEW TYPE FOR TBM

BACKGROUND OF THE PRESENT INVENTION

Field of Invention

The present invention relates to a tunnel boring machine, and more particularly to a shotcrete machine for tunnel boring machine.

Description of Related Arts

Full-section tunnel boring machine is referred to as TBM. With the gradual increase of labor costs, the drilling and blasting construction of the mountain tunnel has gradually been replaced by the boring dragon—the mechanized TBM construction. The shotcrete system, which is an important process of TBM construction, has also received more and more attention. In the past, the step of shotcrete spraying is mainly a manual operation, which not only does not save energy, but also has high rebound, large concrete loss, and poor concrete collection, resulting poor shotcrete spraying environment in the construction site, poor environmental protection, and serious dust pollution. It is imminent to develop a green energy-saving and environmentally friendly shotcrete spraying machine.

SUMMARY OF THE PRESENT INVENTION

In view of the deficiencies of the above background art, the present invention provides a new-type TBM shotcrete machine to solve the technical problems in the prior art, which are high rebound, large loss and poor collection of concrete, and serious dust problems.

The technical solution of the present invention is: a new-type TBM shotcrete machine, which includes a concrete inlet pipe, a four-way pipe, a nozzle, a brush motor, a longitudinal oscillating cylinder, a flow mixer, a lateral oscillating cylinder, a telescopic cylinder for connecting to a boom, and a controller; the telescopic cylinder has one end connected to a connecting panel, the four-way pipe is affixed on an upper portion of the connecting panel, the four-way pipe has two connecting ports at an upper portion thereof connecting to an air inlet pipe and an accelerating admixture inlet pipe respectively, a measuring sensor is provided inside the air inlet pipe, the measuring sensor and the controller are connected to each other, the four-way pipe has two connecting ports at a lower portion thereof connecting to an end of bent pipes respectively, another end of the bent pipes are connected to the flow mixer, the nozzle is connected to a top portion of the flow mixer, the concrete inlet pipe is connected to a bottom portion of the flow mixer, the concrete inlet pipe is connected to the nozzle and the bent pipes through the flow mixer; the longitudinal oscillating cylinder has one end affixed to a lower portion of the connecting panel and another end connected to a support seat, the lateral oscillating cylinder and a motor base are disposed on the support seat, the brush motor has a bottom portion connecting to a connecting shaft, the brush motor is fixedly connected with the motor base through the connecting shaft, a spring and a supporting arm are disposed on the connecting shaft, an eccentric block is provided at an output terminal of the brush motor, the eccentric block cooperates with the supporting arm, and the flow mixer is affixed at an outer side of the supporting arm.

The brush motor, the longitudinal oscillating cylinder and the lateral oscillating cylinder are all connected to the controller.

The supporting arm has a U-shaped and is formed by an upper horizontal plate, a lower horizontal plate and a vertical plate, the lower horizontal plate is provided with a boss, and the boss cooperates with the eccentric block.

The brush motor is vertically and reversely disposed between the upper horizontal plate and the lower horizontal plate.

The vertical plate of the supporting arm is provided with a sliding slot and a sliding plate, the sliding plate is engaged with the sliding slot by bolt, the flow mixer is connected to the supporting arm through the sliding plate.

The number of bent pipe is two, a shape of the bent pipe is a curved shape, and an input end of the air inlet pipe and an input end of the accelerating admixture inlet pipe are connected.

The longitudinal oscillating cylinder is arranged longitudinally and the lateral oscillating cylinder is arranged laterally, the lateral oscillating cylinder and the longitudinal oscillating cylinder are perpendicular to each other, the longitudinal oscillating cylinder has a swing angle of 120°, and the lateral oscillating cylinder has a swing angle is 60°.

The invention is arranged at a front end of the hard rock open type TBM, and is mainly used for the key process of tunnel lining after the TBM cutter head tunneling, and is also used for the emergency spraying treatment during tunnel collapse. The present invention has the characteristics of intelligent regulation, non-linearity and self-adaptation and has completely solved many shortcomings of manual shotcrete spraying in conventional tunnel construction such as low efficiency, high rebound rate, great amount of dust, and serious pollution. The prevent invention can process intelligent adjustment, is energy saving and environmental protection, and can adjust the spacing and angle of the nozzle and the spraying surface in real time according to the air volume, ensuring the proper spacing of the lowest rebound rate and the optimal angle of the nozzle perpendicular to the vertical spraying surface, effectively reducing the rebound rate and reducing the concrete loss, thus has the advantages of energy saving and environmental protection.

DETAILED DESCRIPTION OF THE PREFERRED EMBODIMENT

Embodiment 1

Figure 1:
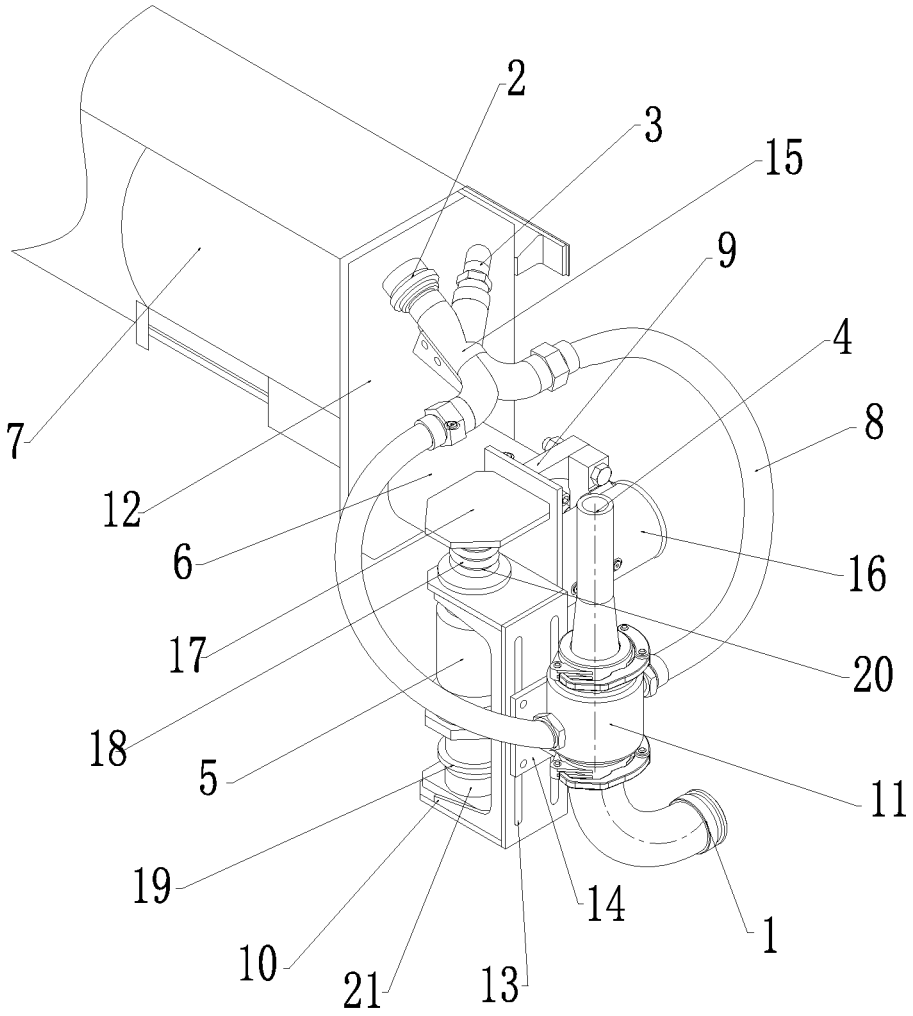
FIG. 1 is a schematic structural diagram of the present invention.

Referring to FIG. 1: a new-type TBM shotcrete machine includes a concrete inlet pipe 1, a four-way pipe 15, a nozzle 4, a brush motor 5, a longitudinal oscillating cylinder 6, a flow mixer 11, a lateral oscillating cylinder 16, a telescopic cylinder 7 for connecting to a boom, and a controller; the telescopic cylinder 7 has one end connected to a connecting panel 12, the four-way pipe 15 is affixed on an upper portion of the connecting panel 12, the four-way pipe 15 has two connecting ports positioned at an upper portion of the four-way pipe 15, which are connected to an air inlet pipe 2 and an accelerating admixture inlet pipe 3 respectively, a measuring sensor is provided inside the air inlet pipe 2, the measuring sensor and the controller are connected to each other, the four-way pipe 15 has two connecting ports positioned at a lower portion of the four-way pipe 15, which are connected to one end of bent pipes 8 respectively, another end of the bent pipes 8 are connected to the flow mixer 11, the nozzle 4 is connected to a top portion of the flow mixer 11, the concrete inlet pipe 1 is connected to a bottom portion of the flow mixer 11, the concrete inlet pipe 1 is connected to the nozzle 4 and the bent pipe 8 through the flow mixer 11; the longitudinal oscillating cylinder 6 has one end affixed to a lower portion of the connecting panel 12 and another end connected to a support seat 9, the lateral oscillating cylinder 16 and a motor base 17 are provided on the support seat 9, the brush motor 5 has a bottom portion connecting to a connecting shaft 20, the brush motor 5 is fixedly connected with the motor base 17 through the connecting shaft 20, a spring 18 and a supporting arm 10 is provided on the connecting shaft 20, an eccentric block 19 is provided at an output terminal of the brush motor 5, the eccentric block 19 cooperates with the supporting arm 10, the flow mixer 11 is affixed at an outer side of the supporting arm 10.

Embodiment 2

Figure 2:
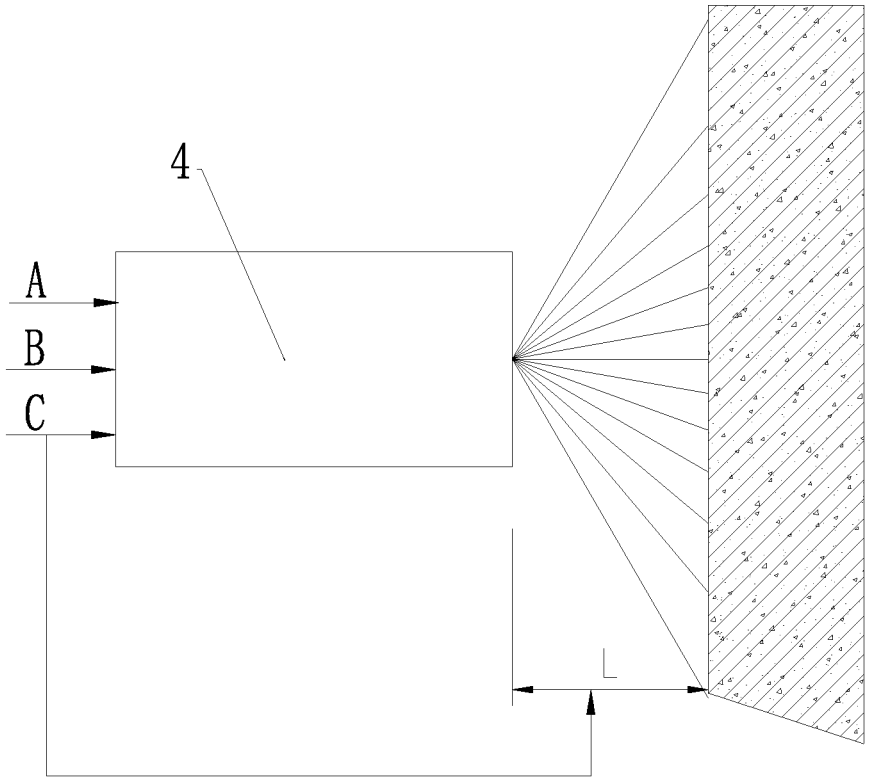
FIG. 2 is a schematic diagram showing the shotcrete spraying process of the present invention.
Figure 3:
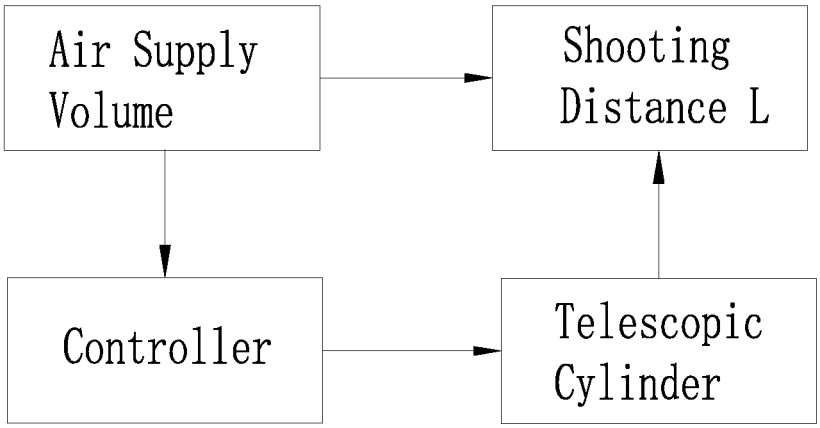
FIG. 3 is a block diagram showing the shotcrete spraying process of the present invention.

Referring to FIGS. 1-3: a new-type TBM shotcrete machine includes a concrete inlet pipe 1, a four-way pipe 15, a nozzle 4, a brush motor 5, a longitudinal oscillating cylinder 6, a flow mixer 11, a lateral oscillating cylinder 16, a telescopic cylinder 7 for connecting to a boom, and a controller; the telescopic cylinder 7 has one end connected to a connecting panel 12, the four-way pipe 15 is affixed on an upper portion of the connecting panel 12, the four-way pipe 15 has two connecting ports positioned at an upper portion of the four-way pipe 15, which are connected to an air inlet pipe 2 and an accelerating admixture inlet pipe 3 respectively, an input end of the air inlet pipe 2 and an input end of the accelerating admixture inlet pipe 3 are connected, and the high pressure wind and the accelerating admixture are mixed at this joining point. A measuring sensor is provided inside the air inlet pipe 2, the measuring sensor and the controller are connected to each other, and the measuring sensor is used to detect air volume for real-time adjustment.

The four-way pipe 15 has two connecting ports positioned at a lower portion of the four-way pipe 15, which are connected to one end of bent pipes 8 respectively, the number of the bent pipes 8 is two and the shape of the bent pipe 8 is curved to facilitate high pressure wind and accelerating admixture to enter the flow mixer 11. Another end of the bent pipes 8 are connected to the flow mixer 11, the nozzle 4 is connected to a top portion of the flow mixer 11, the concrete inlet pipe 1 is connected to a bottom portion of the flow mixer 11, the concrete inlet pipe 1 is connected to the nozzle 4 and the bent pipe 8 through the flow mixer 11. High pressure wind enters into the four-way pipe 15 from the air inlet pipe 2, the accelerating admixture enters into the four-way pipe 15 from the accelerating admixture inlet pipe 3, then high pressure wind and the accelerating admixture are mixed inside the four-way pipe 15 to become accelerator aerosol. The accelerator aerosol passes through the bent pipes 8 to enter into the flow mixer 11. After mixing with the concrete from the concrete inlet pipe 1, the accelerator aerosol and the concrete are sprayed outside together from the nozzle 4. The longitudinal oscillating cylinder 6 has one end affixed to a lower portion of the connecting panel 12 and another end connected to a support seat 9. The longitudinal oscillating cylinder 6 is arranged longitudinally such that the longitudinal oscillating cylinder 6 can swing left and right in a vertical plane, and its swing angle is 120°. The lateral oscillating cylinder 16 and a motor base 17 are provided on the support seat 9, the lateral oscillating cylinder 16 is arranged laterally such that the lateral oscillating cylinder 16 and the longitudinal oscillating cylinder 6 are perpendicular to each other. The lateral oscillating cylinder 16 can swing left and right in a vertical plane, and its swing angle is 60°.

The brush motor 5 has a bottom portion connecting to a connecting shaft 20, the brush motor 5 is fixedly connected with the motor base 17 through the connecting shaft 20, a spring 18 and a supporting arm 10 is provided on the connecting shaft 20, an eccentric block 19 is provided at an output terminal of the brush motor 5, the eccentric block 19 cooperates with the supporting arm 10, a rotational movement of the brush motor 5 will drive a rotational movement of the eccentric block 19, the rotational movement of the eccentric block 19 will cause the supporting arm 10 to swing up and down and left and right at the same time, thereby causing the nozzle to have a brushing movement. A vertical plate of the supporting arm 10 is provided with a sliding slot 13 and a sliding plate 14. The sliding plate 14 is engaged with the sliding slot 13 by bolts. The flow mixer 11 is connected to the supporting arm 10 through the sliding plate 14. The brush motor 5, the longitudinal oscillating cylinder 6 and the lateral oscillating cylinder 16 are all connected to the controller. Through the controller, the swinging and brushing movement of the nozzle can be controlled. The supporting arm 10 has a U-shaped and is formed by an upper horizontal plate, a lower horizontal plate and a vertical plate. The lower horizontal plate is provided with a boss 21, and the boss 21 cooperates with the eccentric block 19. The brush motor 5 is vertically and reversely disposed between the upper horizontal plate and the lower horizontal plate. The brush motor 5 drives the eccentric block to rotate, thereby causing movement of the supporting arm.

Working process: the air inlet pipe is connected with an air compressor, the wind C meets the coagulant B at the input end of the air inlet pipe, and the coagulant becomes an accelerator aerosol under the action of the wind, and then passes through the curved bent pipe to enter the nozzle and is in full contact with the concrete A, and then the three are sprayed out together from the nozzle; during the process, the shooting distance L is adjusted in real time as the air supply volume changes; the controller can control the extension length of the telescopic cylinder, to control the distance between the nozzle and the concrete surface to be sprayed, and better complete the shotcrete spraying process.

The preferred embodiments of the present invention described above is exemplary only and not intended to be limiting. One skilled in the art will understand that variations or alternatives that are conceivable within the scope of the present invention are intended to be encompassed within the scope of the present invention.

What is claimed is:

1. A new-type TBM shotcrete machine, characterized in that: comprising a concrete inlet pipe (1), a four-way pipe (15), a nozzle (4), a brush motor (5), a longitudinal oscillating cylinder (6), a flow mixer, a lateral oscillating cylinder (16), a telescopic cylinder (7) for connecting to a boom, and a controller; the telescopic cylinder (7) having one end connected to a connecting panel (12), the four-way pipe (15) being affixed on an upper portion of the connecting panel (12), the four-way pipe (15) having two connecting ports at an upper portion thereof connecting to an air inlet pipe (2) and an accelerating admixture inlet pipe respectively, a measuring sensor provided inside the air inlet pipe (2), the measuring sensor and the controller being connected to each other, the four-way pipe (15) having two connecting ports at a lower portion thereof connecting to an end of bent pipes (8) respectively, another end of the bent pipes (8) being connected to the flow mixer, the nozzle (4) being connected to a top portion of the flow mixer, the concrete inlet pipe (1) being connected to a bottom portion of the flow mixer, the concrete inlet pipe (1) being connected to the nozzle (4) and the bent pipes (8) through the flow mixer; the longitudinal oscillating cylinder (6) having one end affixed to a lower portion of the connecting panel (12) and another end connected to a support seat (9), the lateral oscillating cylinder (16) and a motor base (17) being disposed on the support seat (9), the brush motor (5) having a bottom portion connecting to a connecting shaft (20), the brush motor (5) being fixedly connected with the motor base (17) through the connecting shaft (20), a spring (18) and a supporting arm (10) being disposed on the connecting shaft (20), an eccentric block (19) being provided at an output terminal of the brush motor (5), the eccentric block (19) cooperating with the supporting arm (10), and the flow mixer being affixed at an outer side of the supporting arm (10).

2. The new-type TBM shotcrete machine according to claim 1, characterized in that: the brush motor (5), the longitudinal oscillating cylinder (6) and the lateral oscillating cylinder (16) are all connected to the controller.

3. The new-type TBM shotcrete machine according to claim 1, characterized in that: the supporting arm (10) has a U-shaped and is formed by an upper horizontal plate, a lower horizontal plate and a vertical plate, the lower horizontal plate is provided with a boss (21), and the boss (21) cooperates with the eccentric block (19).

4. The new-type TBM shotcrete machine according to claim 3, characterized in that: the brush motor (5) is vertically and reversely disposed between the upper horizontal plate and the lower horizontal plate.

5. The new-type TBM shotcrete machine according to claim 3, characterized in that: the vertical plate of the supporting arm (10) is provided with a sliding slot (13) and a sliding plate (14), the sliding plate (14) is engaged with the sliding slot (13) by bolt, the flow mixer is connected to the supporting arm (10) through the sliding plate (14).

6. The new-type TBM shotcrete machine according to claim 1, characterized in that: a shape of the bent pipe (8) is a curved shape, and an input end of the air inlet pipe (2) and an input end of the accelerating admixture inlet pipe are connected.

7. The new-type TBM shotcrete machine according to claim 1, characterized in that: the longitudinal oscillating cylinder (6) is arranged longitudinally and the lateral oscillating cylinder (16) is arranged laterally, the lateral oscillating cylinder (16) and the longitudinal oscillating cylinder (6) are perpendicular to each other, the longitudinal oscillating cylinder (6) has a swing angle of 120°, and the lateral oscillating cylinder (16) has a swing angle is 60°.

* * * * *